United States Patent [19]

Chételat et al.

[11] 4,094,138

[45] June 13, 1978

[54] ELECTRONIC CHRONOGRAPH

[75] Inventors: Fernand Chételat, Cortaillod; Pierre Hersberger, Neuchatel, both of Switzerland

[73] Assignee: Ebauches S.A., Neuchatel, Switzerland

[21] Appl. No.: 598,691

[22] Filed: Jul. 24, 1975

[30] Foreign Application Priority Data

Aug. 9, 1974 Switzerland ..... 11303/74

[51] Int. Cl.[2] ..... G04F 8/00

[52] U.S. Cl. ..... 58/39.5; 58/23 R; 364/783

[58] Field of Search ..... 58/23 R, 22.9, 21.13, 58/39.5, 50 R; 235/174, 175, 92 T, 169, 170

[56] References Cited

U.S. PATENT DOCUMENTS

| | | | |
|---|---|---|---|
| 2,795,378 | 6/1957 | Beranger | 235/170 |
| 3,257,549 | 6/1966 | Mahro | 235/174 |
| 3,424,898 | 1/1969 | Lukens | 235/174 |
| 3,508,037 | 4/1976 | Collins et al. | 235/169 |
| 3,596,074 | 7/1971 | Mitrofanoff | 235/175 |
| 3,686,880 | 8/1972 | Samejima | 235/59.5 |
| 3,752,394 | 8/1973 | Igel | 235/175 |
| 3,806,719 | 4/1974 | Tamamura et al. | 235/170 |
| 3,809,872 | 5/1974 | Yamamura et al. | 235/170 |

OTHER PUBLICATIONS

"Serial Digital Adders for Variable Radix of Notation", R. Townsend, Electronic Engineering, 10/1953, pp. 410–416.

"Subtraction by Minuend Complementation", Glen G. Langdon, IEEE Transactions on Computers, Jan., 1969.

*Primary Examiner*—B. Dobeck
*Assistant Examiner*—Vit W. Miska
*Attorney, Agent, or Firm*—Imirie, Smiley & Guay

[57] ABSTRACT

The chronograph comprises a device allowing to memorize at least two lapses of time and a subtraction device to effect the absolute difference between two lapses of time or time intervals which are memorized and preselected. The subtraction device includes:

(a) a first array of complete subtractors which effect a first difference between the decimals, converted in binary numbers, forming two lapses of time memorized and selected, by taking in account an eventual carry over.

(b) a second array of complete subtractors adapted to take the complement of the said first difference if the subtrahend is greater than the minuend, the carry over issued from the difference between the decimals of the greatest weight being used to form the complement number, this carry over being further used as discrimination element between the said first difference and the complementary number.

7 Claims, 4 Drawing Figures

ELECTRONIC CHRONOGRAPH

BACKGROUND OF THE INVENTION

This invention relates to an electronic chronograph comprising a device for memorizing at least two lapses of time.

It may be useful, particularly in sports competition, to obtain with a chronograph of the above-mentioned type, the difference between two lapses of time or time intervals which are memorized and displayed, by the simple act of pressing a push-button, for example, without being obliged to make a mental arithmetic operation where miscalculations can easy be made.

SUMMARY OF THE INVENTION

According to the present invention, a chronograph comprises a subtraction device including:

(a) a first array of complete subtractors which effect a first difference between the decimal digits, converted in binary numbers, forming two lapses of time memorized and selected, by taking in account an eventual carry-over;

(b) a second array of complete subtractors adapted to take the complement of the said first difference if the subtrahend is greater than the minuend, the carry over issued from the difference between the decimal digits of the greatest weight being used to form the complement number, this carry over being further used to discriminate for display purposes between the said first difference and the complementary number.

DESCRIPTION OF THE PREFERRED EMBODIMENT

The term "complete subtractor", as used in the present specification, is intended to refer to a device which takes the difference between two bits A and B, of the order — i — while taking into account a possible carry-over $C_{i-1}$ of the order i−1 which is immediately inferior.

The truth table herein below shows the results X, and the carryover obtained with a complete subtractor.

| $A_i$ | $B_i$ | $C_{i-1}$ | $X_i$ | $C_i$ |
|---|---|---|---|---|
| 0 | 0 | 0 | 0 | 0 |
| 0 | 0 | 1 | 1 | 1 |
| 0 | 1 | 0 | 1 | 1 |
| 0 | 1 | 1 | 0 | 1 |
| 1 | 0 | 0 | 1 | 0 |
| 1 | 0 | 1 | 0 | 0 |
| 1 | 1 | 0 | 0 | 0 |
| 1 | 1 | 1 | 1 | 1 |

Figure 1A:
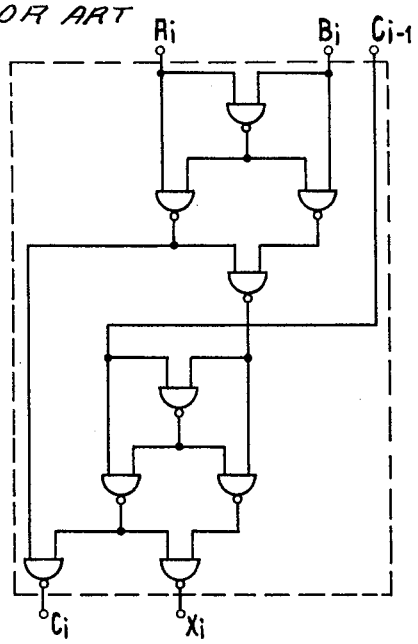
FIG. 1A PRIOR ART
FIGS. 1A and 1B are schematic logic circuit diagrams of known complete subtractors which may be used in conjunction with the present invention.
Figure 1B:
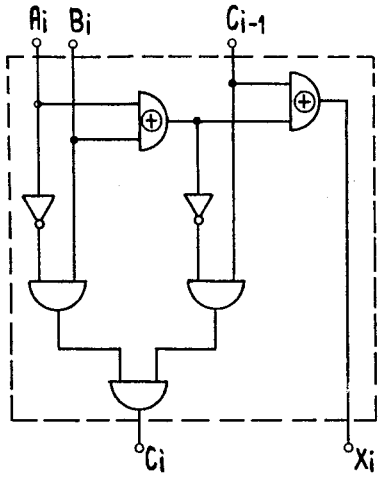
FIG. 1B PRIOR ART

A complete subtractor may be realized in two ways: Fig. 1A shows a first embodiment with NAND-gates. FIG. 1B shows a second embodiment with two exclusive NOR-gates, two inverters and three AND-gates.

Figure 2:
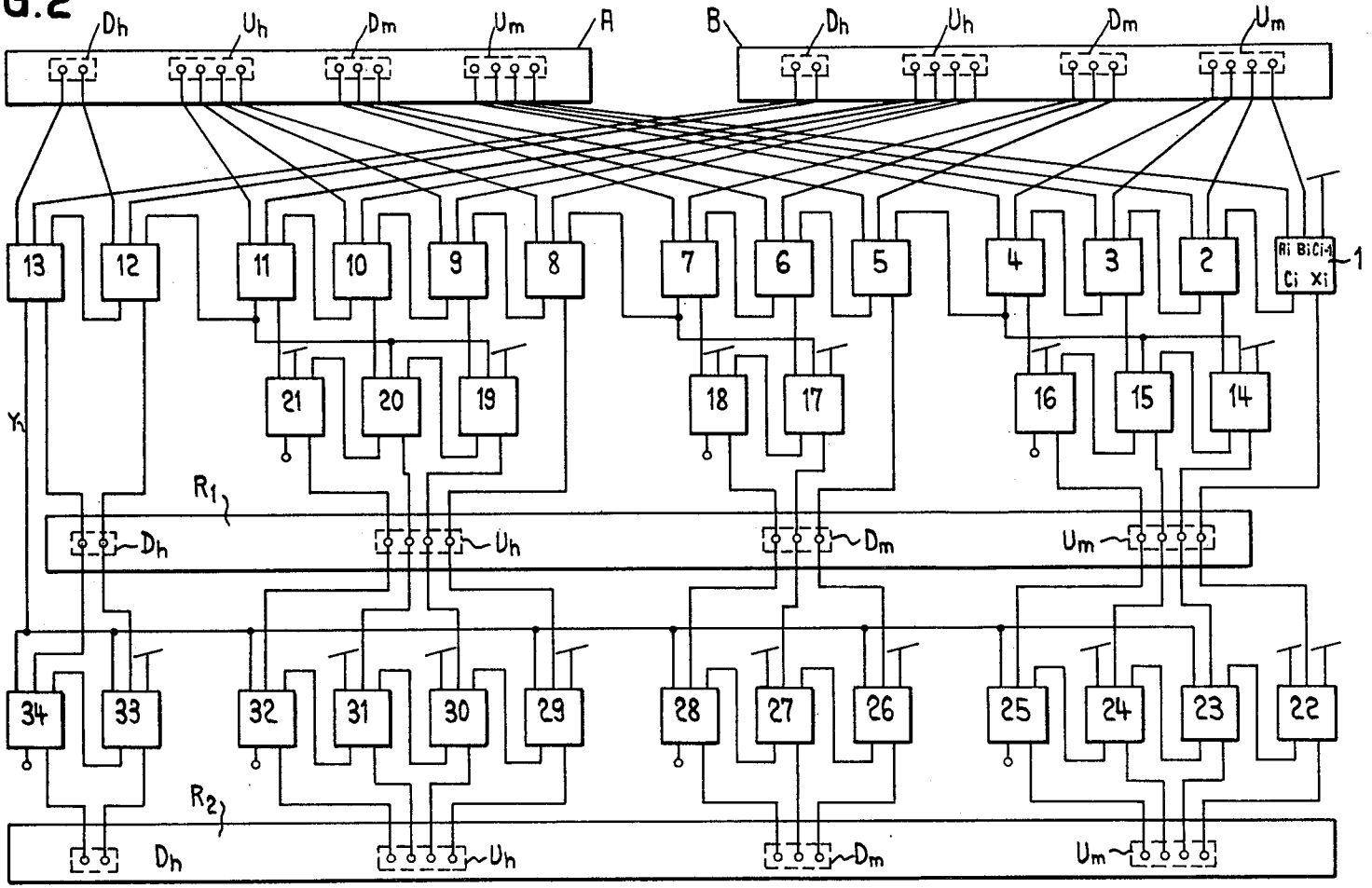
FIG. 2 is a schematic logic circuit diagram of a preferred embodiment of a subtraction device according to the present invention.

FIG. 2 shows a preferred embodiment of a subtraction device according to the invention. All the blocks 1 to 34 are complete subtractors which can have the structure of FIG. 1A or 1B. For clarity, the the circuit connections are shown only for the complete subtractor 1, where the inputs $A_i$, $B_i$ and $C_{i-1}$ and the outputs $X_i$ and $C_i$ are labeled. It is to be noted that (the subtrahend $B_i$ is subtracted from $A_i$ (the minuend). The two lapses or intervals of time A and B are memorized in the chronograph in a binary form: The minute units $U_m$ and the units of the hours $U_h$ need four bits, because it is possible with four bits to count from zero up to ten. The tens of minutes $D_m$ only need three bits because the tens of minutes digit be six at the most. For the tens of hours $D_h$, two bits will be enough because we admit that the memorized lapses or intervals of time will not exceed twenty four hours.

The subtraction device includes a first array of complete subtractors 1 to 13 which performs bit after bit the difference between the lapses A and B. The output $C_i$ of each complete subtractor is connected to the input $C_{i-1}$ of the following or next highest order subtractor. The input $C_{i-1}$ of the subtractor 1 is connected to a logic potential "0". Below the subtractors 1 to 4 performing the difference between the units of minutes $U_m$, three subtractors 14 to 16 are represented: the inputs $B_i$ of the subtractors 14 and 15 are connected to the output $C_i$ of the subtractor 4 while the input $B_i$ of the subtractor 16 and the input $C_{i-1}$ of the subtractor 14 are connected to a potential "0". The connections are the same for the subtractors 19 to 21 represented below the subtractors 8 to 11 performing the difference between the units of hours $U_h$ of the lapses A and B. Below the subtractors 5 to 7 performing the difference between the tens of minutes $D_m$, two subtractors 17 and 18 are represented: the input $C_{i-1}$ of the subtractor 17 and the input $B_i$ of the subtractor 18 are at the potential "0". The input $B_i$ of the subtractor 17 is connected to the output $C_i$ of the subtractor 7. If the lapse A is greater than the lapse B, the result $R_1$ can be read on the outputs $X_i$ of the subtractors 1, 14, 15, 16 for the units of minutes $U_m$, 5, 17, 18 for the tens of minutes $D_m$, 8, 19, 20, 21 for the units of hours $U_h$ and 12, 13 for the tens of hours $A_h$. It is noted that for example, the number of units of minutes $U_m$ of the lapse B can be greater than the number of units of minutes $U_m$ of the lapse A. In a conventional operation in a decimal system, to perform the following subtraction:

52 − 24 where the number of units of the number "twenty-four", namely "four" is greater than the number of units of the number, "fifty-two", namely "two" the number of units of the result can be found by performing the operation:

12 − 4 in other words, we add ten to the minuend, or we put a "one" before the number of unit of the minuend. If we put a "1" before the binary number forming the $U_m$, in the foregoing example:

0010 (= 2) — 10010 (= 18)

we do not add only ten but sixteen (= 10000), that is, six units too much. In such cases, the subtraction device performs the difference as if there were a one before the binary number and subtracts six systematically from the result obtained with the subtractors 1, 2, 3 and 4. This operation is performed in the subtractors 14, 15 and 16: in our example:

| | |
|---|---|
| 0010 | (= 2) |
| − 0100 | (= 4) |
| 1110 | (= 14) |
| − 0110 | (= 6) |
| 1000 | (= 8) |

The binary number "6" can be formed with the carry-over $C_i$ of the subtractor 4. The procedure is the same for the units of hours $U_h$, where the binary number "6" is formed with the carry-over $C_i$ of the subtractor 11.

The problem is similar for the tens of minutes $D_m$. But if the number of $D_m$ of A is greater than the number of $D_m$ of B, in conventional arithmetics with lapses of time, we do not add "10" to the minuend but only "6", because we must deduct six tens of minutes i.e., one unit of hours from the number of units of the hours to add them to the number of tens $D_m$ of the minutes by placing a "1" before the binary number of $D_m$, we do not add "6" but "8" (= 1000): consequently, if there is a carry-over $C_i$ = "1" at the subtractor 7, the subtraction device will subtract "2" from the result obtained at the outputs $X_i$ of the subtractors 5, 6 and 7. This operation is performed by the subtractors 17 and 18. A simple example will show this operation:

1h 20 min − 40 min = 60 min° 20 min − 40 min
= 80 min − 40 min
= 40 min.

we make the operation with the tens only:

| | |
|---|---|
| 010 | (= 2 tens of minutes) |
| − 100 | (= 4 tens of minutes) |
| 110 | (= 6 ) |
| − 010 | (= 2 ) |
| 100 | (= 4 tens of minutes) |

The deduction of an hour from the number of units of the hour is also made with the carry-over $C_i$ at the output of the subtractor 7. If the number of tens of the hours $D_h$ of the lapse B is greater than the same of the lapse A by taking in account a possible carry-over $C_i$ coming from the subtractor 13, this will mean that the lapse B is greater than the lapse A. In this case, the subtraction device forms a complement $R_2$ to the result $R_1$ with the subtractors 22 to 34 and with the carry-over $C_i$ Y of the subtractor 13. In the conventional decimal-system, if the largest number is deducted from the small one, the result is called ten complement: for example:

| |
|---|
| 232 |
| − 564 |
| ...999668 |

To find the absolute difference, we write the complement to ten of the number of units and the complements to nine of the other decimals (in the foregoing example: 10 − 8 = 2; 9 − 6 = 3; 9 − 6 = 3; 9 − 9 = 0 . . . the difference is: 332). In the subtraction device of the FIG. 2, the number of $U_m$ will be complemented to ten (binary: 1010), the number $D_m$ to 5 (binary: 101; the "ten" of the tens of minutes being "six"), the number of $U_h$ to nine (binary: 1001), the number of $D_h$ to three (binary: 11). In this later case, this complementarity is understandable because there are only two bits to express the tens of hours: the immediately following ten will be four (binary: 100). All the complement numbers are formed with the carry-over Y. This later can also be used to make the choice between the results $R_1$ or $R_2$. If:

A > B, then Y = 0 and the difference is given by $R_1$. However, if

Figure 3:
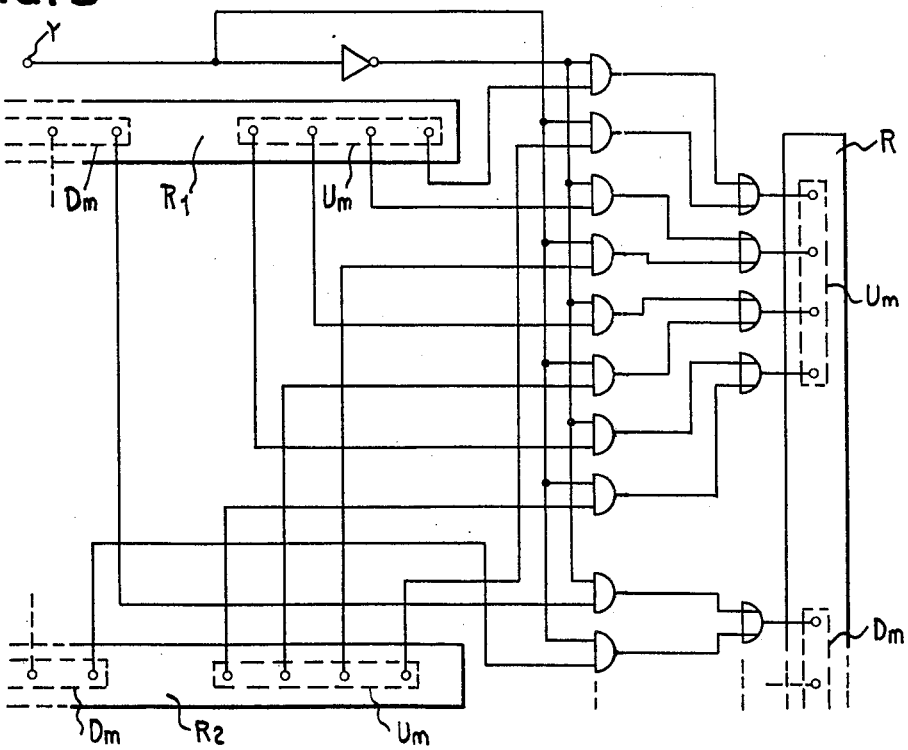
FIG. 3 is a partial schematic diagram of a discriminator according to the present invention.

A > B, then Y = 1 and the difference is given by $R_2$. This can be realized with a multiplexer driven by the signal Y. The FIG. 3 shows partly a multiplexer. Only a part of the bits of the binary numbers forming the results $R_1$ and $R_2$ are shown; but it is easy to see that each pair of the corresponding bits of the results $R_1$ and $R_2$ supplies two AND-gates, one of them being driven by the signal Y, the other being driven through an inverter by the inverse signal Y. The outputs of the AND-gates are fed to the inputs of an OR-gate network, at the output of which appears the final result R.

It is evident that the memorized lapses of time can include tens of seconds, units of seconds, tenths of seconds . . . etc. In this case, further complete subtractors are needed connected according the same principle as for the units of minutes, tens of minutes, etc. . . and taking into account that a minute includes sixty seconds.

What we claim is:

1. An electronic chronograph for calculating the difference between two intervals of time, each decimal digit of which is represented as a binary word, comprising a subtracting circuit including a plurality of functionally similar subtracting units connected to form a plurality of sets of parallel groups, each group representing a decimal digit and comprised of a plurality of parallel subtracting units, said subtracting circuit comprised of a first set of said subtracting units including a group of subtracting units for each word for producing the time differences between each corresponding word of said intervals of time, the subtracting unit of highest significance of each group having a carry-over output, and a second set of said subtracting units including groups of subtracting units interconnected each with a group of said first set, each group of said second set having a control input of at least one of its subtracting units connected to said carry-over output of the corresponding group of said first set of subtracting units for subtracting a correcting cipher from each of said differences whenever said carry-over output has a carry-over signal such that each group has its own correcting cipher based on the resultant decimal digit to which that group corresponds and hence at least two groups have different correcting ciphers, said first and second sets of subtracting units having first groups of outputs delivering a first corrected time difference, whereby said first output groups represent the time difference between said intervals when said subtrahend is less than said minuend, and the complement of said set of output groups represent the time difference between said intervals when said subtrahend is greater than said minuend.

2. An electronic chronograph according to claim 1 wherein said subtracting circuit further includes a third set of subtracting units including groups of subtracting units connected each to corresponding first output groups, each group of said third set of subtracting units having a control input of at least one of its subtracting units connected to the carry-over output of the group of highest significance of said first set of subtracting units for subtracting a correcting number from said first corrected time difference whenever said carry-over output of the group of highest significance produces a carry-over signal, said third subtracting units having said second groups of outputs delivering a second corrected time difference; and wherein said electronic chronograph further comprises:

selector means controllable by said carry-over signal from said group of highest significance of said first set of subtracting units for selecting said first or second corrected time difference.

3. An electronic chronograph according to claim 2, wherein said subtracting circuit essentially consists of said subtracting units and interconnecting means for directly coupling the inputs and outputs of said subtracting units.

4. An electronic chronograph according to claim 2, wherein each subtracting unit of said second and third set has a control input, such control inputs being selectively connected to one of said carry-over outputs and to a logical zero potential, such connections determining the cipher and number respectively to be subtracted by said groups of subtracting units.

5. An electronic chronograph according to claim 2, wherein said first and third set of subtracting units each have four groups associated with the units of minutes, tens of minutes, units of hours and tens of hours, and wherein said second set of units has groups associated to units of minutes, tens of minutes and units of hours.

6. An electronic chronograph according to claim 5, wherein said groups of units of said second set are connected to said carry-over outputs of said first sets for introducing correcting ciphers "6" by the groups associated with the units of minutes and hours and the cipher "2" by the group associated with the tens of minutes.

7. An electronic chronograph according to claim 5, wherein said groups of units of said third set are connected to said carry-over output of said group of highest significance of the first set of units for complementing said first corrected time difference to "10", "5", "9", and "3" respectively going from the units of minutes to the tens of hours.

* * * * *